United States Patent [19]

Kobayashi et al.

[11] Patent Number: 4,807,403

[45] Date of Patent: Feb. 28, 1989

[54] ROTATING BARREL FINISHING METHOD UNDER HEAVY RESULTANT FORCE

[75] Inventors: Hisamine Kobayashi; Katsuhiro Izuhara, both of Nagoya, Japan

[73] Assignee: Tipton Manufacturing Corporation, Aichi, Japan

[21] Appl. No.: 167,843

[22] Filed: Mar. 14, 1988

[30] Foreign Application Priority Data

Mar. 20, 1987 [JP] Japan ..... 62-66949

[51] Int. Cl.[4] ..... B24B 1/00; B24B 31/02

[52] U.S. Cl. ..... 51/313; 51/164.2

[58] Field of Search ..... 51/163.1, 164.1, 164.2, 51/313

[56] References Cited

U.S. PATENT DOCUMENTS

| | | | |
|---|---|---|---|
| 3,374,584 | 3/1968 | Haught | 51/164.1 |
| 4,041,648 | 8/1977 | Heiberger | 51/164.1 |
| 4,586,292 | 5/1986 | Carroll et al. | 51/164.2 X |
| 4,638,600 | 1/1987 | Kobayashi et al. | 51/164.2 |
| 4,727,684 | 3/1988 | Kobayashi et al. | 51/164.2 |

*Primary Examiner*—James G. Smith

*Attorney, Agent, or Firm*—Wenderoth, Lind & Ponack

[57] ABSTRACT

A method consists of causing a barrel container to revolve with less than the numbers of axial and orbital revolutions n and N defined as $n=42.2/\sqrt{d}\ x^4\sqrt{1+x^2}$, where n is the number of axial revolutions per minute for the barrel container, x is ratio of the centrifugal force produced and the gravity, equal to $o<x\leqq 1$, d is the diameter of the inscribed circle of said barrel container; and $N=42.2/\sqrt{D}$, where N is the number of revolutions per minute and D is the distance, in meter, twice value from the revolving axis and rotating one; and causing a resultant force substantially equal to $1G<Y\leqq\sqrt{2G}$ where Y is defined as the resultant force to be produced by the centrifugal force combined with the gravity action and given to the mass within the barrel container. The method provides a heavy resultant force that is composed of the produced centrifugal force component and gravity action component, under which the workpieces can be finished with the higher efficiency. Various types of workpiece finishing are available on a single machine implemented on the method, by making use of a programmable sequence controller.

1 Claim, 4 Drawing Sheets

ROTATING BARREL FINISHING METHOD UNDER HEAVY RESULTANT FORCE

BACKGROUND OF THE INVENTION

1. Field of the Invention

The present invention relates generally to the art of finishing workpieces by using rotary barrels, and more particularly to a method whereby a centrifugal force is produced within those rotary barrels, thereby providing for improved workpiece finishing efficiency and uniformity.

2. Description of the Prior Art

A conventional workpiece finishing method of the class disclosed herein consists of using a rotary barrel having the polygonally-formed container having multiple sides which contains workpieces to be surfacefinished or otherwise processed as well as the abrasive media including a compound solution (the mixture of which will be referred to collectively as a "mass"), and causing the rotary barrel to rotate on its axis. the axial rotation of the rotary barrel in this manner produces a centrifugal force which causes the workpiecees and abrasive media to interact against each other. When the barrel is rotating with the proper number of revolutions, the mass within the barrel can have a flow layer formed above it. Thus, the smooth finishing process can occur. With the increasing number of revolutions, however, the mass may flow in a disorderly fashion which may cause the mass to lose its ability to flow smoothly. This may have the accompanying effect of letting part or all of the mass to fall or follow the projectile motion. Thus, the finishing process cannot occur properly. When the number of revolutions is increased further, a centrifugal force may be produced, bringing all the mass closer to the inner barrel wall and forcing it against the wall. Finally and eventually, the mass remains motionless. In that condition, it would be practically impossible to continue the processing. When the mass has the behavior or motions as described above within the polygonally-formed container, the relationships between the diameter d (m) of an inscribed circle across the polygonal shape and the number of revolutions n (rmp) have been defined. According to this definition, the optimum running requirements can be met when $n=14/\sqrt{d}$, the maximum amount of work can be achieved when $n=32/\sqrt{d}$, and for $n-42.2\sqrt{d}$, the mass may be forced against the barrel wall under the action of the produced centrifugal force. According to the conventional finishing process, therefore, it has been observed that when the number of revolutions n is greater than $14/\sqrt{d}$, the resulting performance may be degraded rather than being improved. There are various types of abrasive media and compounds available for use with the various types of workpieces and they have been improved to allow for the further increased number of revolutions n. Still, the maximum possible number of rovolutions is limited to $n=20/\sqrt{d}$, and any value beyond this maximum would adversely affect the finishing efficiency. For this reason, the conventional finishing method as described above can only be used within the value of $n=20/\sqrt{d}$.

Another conventional finishing method is known, which consists of using a high-speed revolving barrel and causing a centrifugal force to be produced within the barrel, within which the mass can flow under the influence of the produced centrifugal force. This method provides the enhanced finishing efficiency.

When the mass is placed under the influence of the centrifugal force, it is forced against the barrel wall as described earlier. In order to prevent this situation, the second-mentioned conventional method employs the conceptual principle of operation whereby a barrel is mounted to a high-speed turret so that the former can rotate with the latter in an eccentric relationship with regard to the latter. When the turret is rotating with a given number of rovolutions N per minute, the mass within the barrel is also subjected to the produced centrifugal force which brings the mass closer to the barrel wall. To overcome the action of the centrifugal force, the barrel which is supported on its own shaft is also driven for axial rotation with a given number of revolutions n per minute. If the ratio of n/N has a certain value, a flow layer is formed on the surface of the mass, and a good result is obtained. It is known that when $n/N=-1$, which means that the turret and barrel are rotating in the opposite directions with the same number of revolutions, the best result may be obtained. The definition of the centrifugal barrel is determined that the centrifugal force produced by rotating the turret exceeds the limit that the mass is compacted against the barrel wall if there is no rotation about the barrel axis. The upper limit for N is defined as $N=42.2/\sqrt{D}$ (where D is equal to two times the distance between the center axis of the barrel and the center axis of the turret, in meters). In those years, the needs for the barrel finishing technology that allows for the very high-precision and very high-speed finishing process have been increasing as the increasing number of a variety of electronic components or parts using ceramics or fragile materials have been developed and used. In order to meet those needs, the centrifugal barrel finishing method has been used. In some cases, however, there may be problems of producing too strong centrifugal force during the operation, or causing a disorderly flow of the mass at the start or end of the operation. In either case, the finished surface may be injured. For this reason, an alternative solution must be provided that could meet the requirements for high precision and strainless workpiece finishing. It is said that the rotary barrel finishing method provides the equivalent capabilities of the very high-precision finishing and lapping when it is used under the adequate conditions, and the corresponding results can be obtained therefrom. It is also noticed that the finishing speed that can be attained by that method is very slow. More specifically, the conventional rotary barrel finishing method consists of producing a centrifugal force which in turn produces a greater resultant force upon the mass during the finishing process, thereby increasing the finishing speed with which the high-precision barrel finishing process can occur. As a possible alternative solution whereby the finishing speed may be increased by increasing the number of revolutions for the barrel above $n=20/\sqrt{D}$, the shaft supporting the barrel may be eccentric with regard to the turret shaft, and the turret may be rotated with the reduced number of revolutions while the barrel may be rotated on its shaft, as it is done for the centrifugal flow barrel. When this proposed solution is used with the conventional centrifugal barrel supported by its horizontal shaft, the magnitude of the centrifugal force that is produced may vary as the barrel is rotating around the turret, changing its orbital position, as shown in FIG. 1 (which is provided for the centrifugal force of IG, in which it is shown that for $n/N=-1$, the acceleration produced by the centrifugal force has a value equal to that for the acceleration by the gravity. This condition will be referred to hereinafter as simply to the centrifugal force G, or xG when the acceleration by the centrifugal force is equal to x times the acceleration by the gravity). Thus, the magnitude of the force that is applied to the mass may vary during a complete revolution of the barrel, causing a disorderly flow of the mass. It may be appreciated that this may adversely affect the finishing efficiency. When that propoed solution is used with the centrifugal flow barrel supported by its vertical shaft, the resultant centrifugal force that is produced during the complete revolution has the same magnitude, as opposed to the horizontal shaft barrel, but the mass flow may have its surface inclined. Thus, the smooth mass flow cannot be obtained. As the mass contains workpieces of different specific gravity, the workpieces may be separated, depending upon the different specific gravities. Those workpieces which have a greater specific gravity may fall down, gathering together on or near the bottom. This may produce damages to those workpieces by causing them to strike against each other.

SUMMARY OF THE INVENTION

The present invention provides an improvement to the conventional methods that have been mentioned and described above. According to the present invention, a barrel container has a polygonal cylindrical shape having a plurality of sides, as shown in FIG. 2(a). Although the barrel container may have as many sides as necessary, six or eight sides should preferably be provided. Five or seven sides are functionally or principally equivalent to those six or eight sides, but the barrel construction that provides the six or eight sides is easier to be manufactured. The barrel container is rotatably supported by its horozontal shaft, and is mounted to a turret rotatably supported by its main spindle so that the barrel container can revolve about the turret on a plane including the barrel shafts and turret plane. When a centrifugal force of IG, for example, is to be produced, the barrel construction is designed so that the center section through the barrel container, extending perpendicularly to its horizontal shaft, will always receive a resultant force of $\sqrt{2G}$ (the force composed of the centrifugal force and gravity action components). In general, when the ratio is x, the resultant force is $\sqrt{1+x^2G}$ as shown in FIG. 2(b). The values of $\sqrt{2G}$ and $\sqrt{1+x^2G}$ remains constant at every orbital point of the barrel container revolving about the turret. Thus, the smooth and constant mass flow layer can be formed, thereby providing the higher finishing efficiency with the high precision. For the method that is specifically designed for the rotary barrel finishing purposes, the primary source of the force applied upon the mass is the action of gravity, whereas according to the present invention, the centrifugal force produced by rotating the turret is combined with the action of gravity. As the direction of the centrifugal force action remains unchanged at every point of the barrel container revolving about the turret, the higher finishing efficiency can be provided by the method of the invention, than that by the usual rotary barrel finishing method. For this reason, the method according to the present invention may be termed as "rotary barrel finishing under heavy resultant force" as it appears in the title of the invention. Furthermore, the method according to the present invention may be thought of as the method whereby the rotary barrel finishing process can proceed in the field of the action of the centrifugal force produced by the revolution of the turret coupled with the gravity. As such, the number of revolutions with which the barrel container can turn about its own shaft is not limited to $n/N=-1$ which is specified as the optimum operating requirements for the usual centrifugal barrel finishing. Instead, any number of revolutions may be selected, depending upon the different finishing requirements, and its upper limit may be raised to a much higher value than what was possible with the usual rotary barrel finishing method. A further important aspect of the present invention is that any intended change in the direction of axial rotation for the barrel container will only be followed with the change in the position of the mass within the barrel container. The manner in which the mass can flow remains unchanged, regardless of the direction of rotation. It should be understood that although the number of revolutons for the turret may also be increased up to the value range that was specific to the usual conventional centrifugal flow barrel finishing process, any value that would exceed $N=42.2/\sqrt{D}$ (which is defined to force the mass against the barrel wall if the barrel container is non-rotational) would fall within the scope of the usual centrifugal flow finishing process (exactly different from what is generally called the centrifugal flow barrel finishing process). Therefore, it is not applicable to the present invention.

Another conventional finishing process that utilizes the parallel turret shaft and barrel shaft arrangement by causing a centrifugal force action upon the mass within the barrel is currently available. In this case, it may be possible to reduce the value of N below $N=42.2/\sqrt{D}$ under which this type of finishing process may proceed. However, it provides no advantages that have been described in conjunction with the present invention.

BRIEF DESCRIPTION OF THE DRAWINGS

Those and other objects, advantages, and features of the present invention will become apparent from the detailed description of several preferred embodiments that follows hereinafter by referring to the accompanying drawings, in which:

FIG. 2(*b*) is a similar diagram as FIG. 2(*a*), when the ratio of centrifugal force and the gravity is x;

DESCRIPTION OF THE PREFERRED EMBODIMENTS

Figure 1:
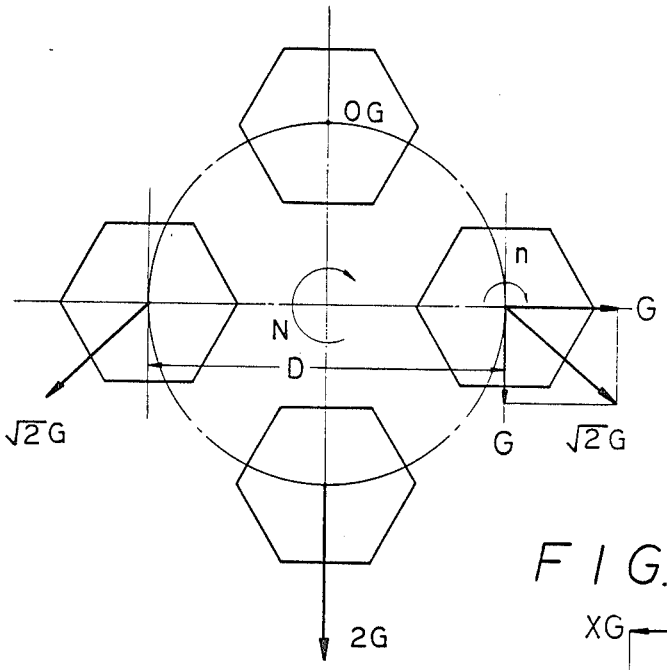
FIG. 1 is a conceptual schematic diagram illustrating how the forces produced during the conventional centrifugal barrel finishing process behave themselves.
Figure 2B:
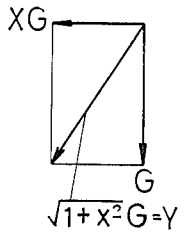
FIG. 2(*a*) is a simialr diagram of FIG. 1 but provided to illustrate the actions of the forces produced according to the present invention.
Figure 2A:
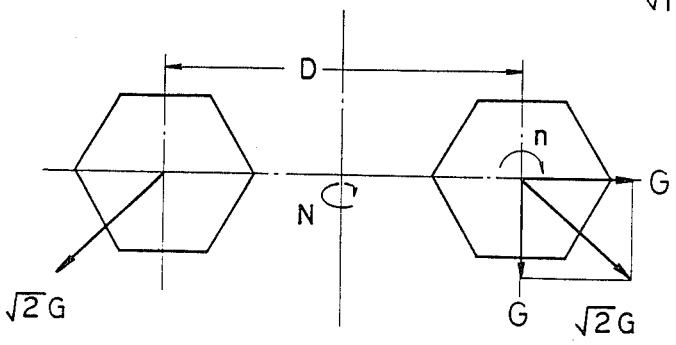
Figure 3:
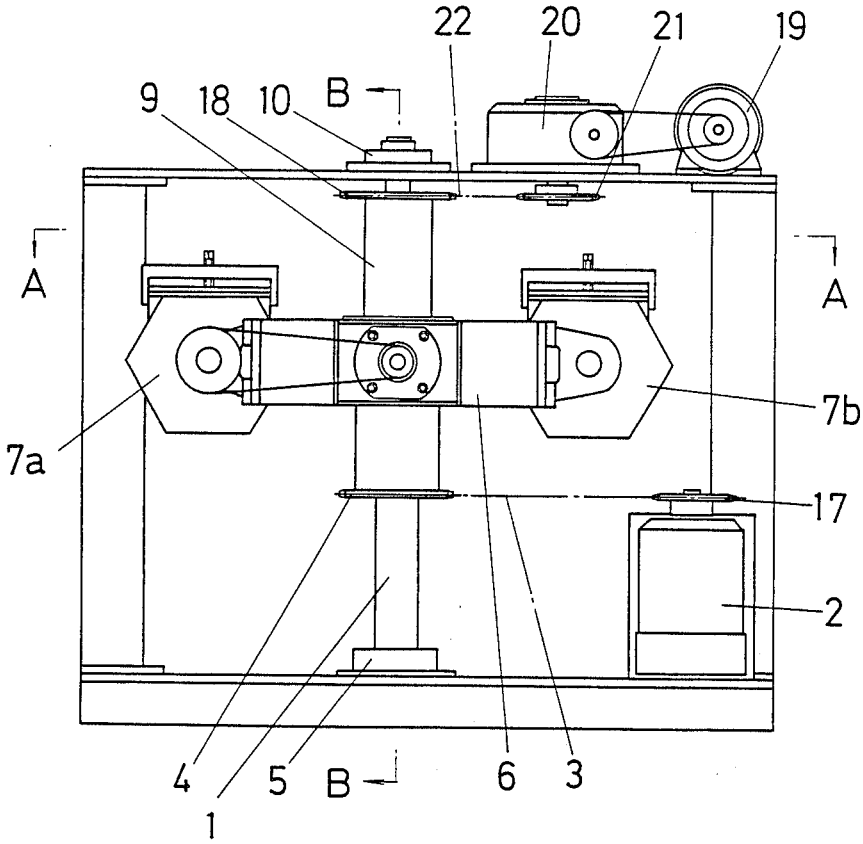
FIG. 3 is a front elevation of a particular apparatus specifically designed for use with the method of the present invention.
Figure 4:
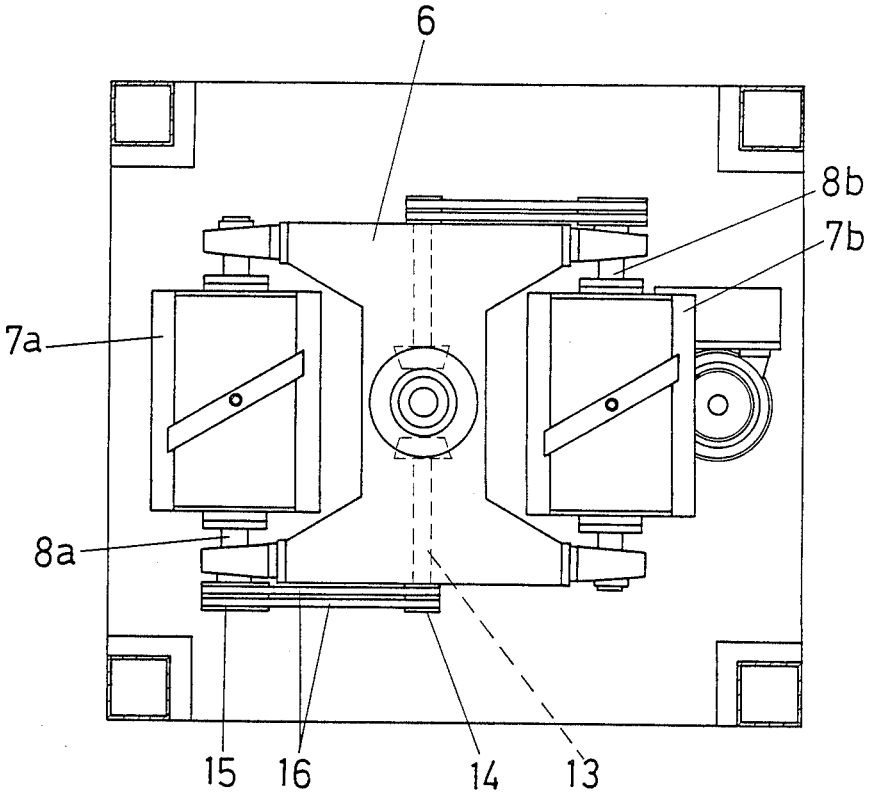
FIG. 4 is a plan view of the apparatus in FIG. 3.
Figure 5:
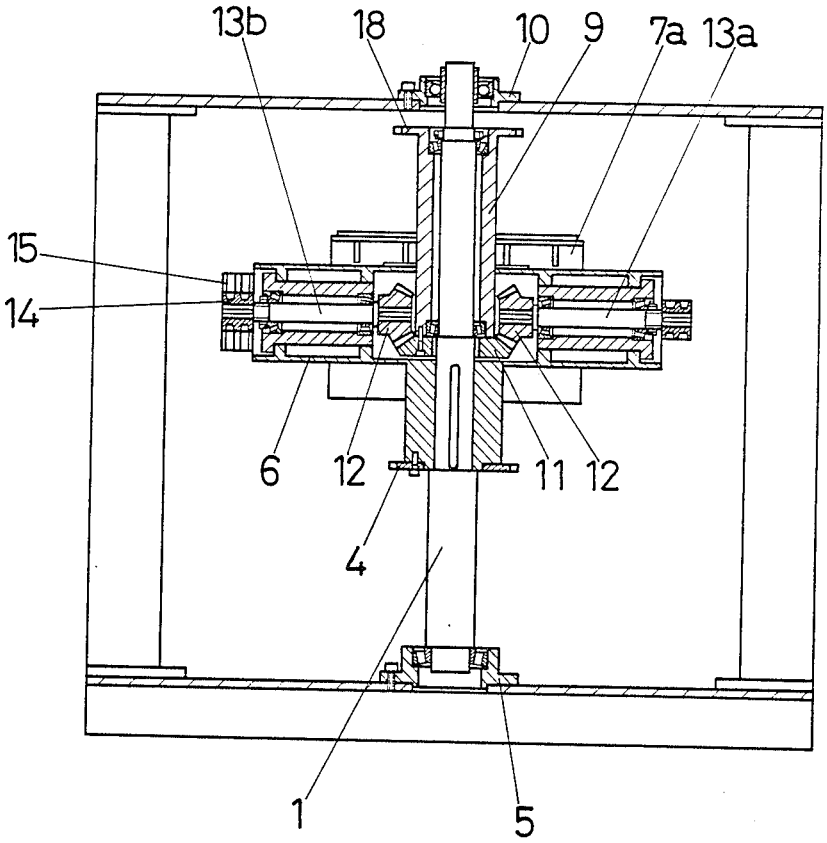
FIG. 5 is an enlarged sectional view of the apparatus in FIG. 3.

FIGS. 3 through 5 illustrates the arrangement of a particular form of the apparatus that is specifically designed for use with the method of the present invention. As particularly shown in FIG. 3, the apparatus includes a framed structure within which a main spindle 1 is mounted vertically across the structure, and a combination of a main motor 2, a sprocket wheel 17 and a chain 3 is provided for driving the main spindle 1 through its sprocket wheel 4. The number of revolutions for the main spindle 1 may be controlled variably by means of a per-se known frequency inverter. The main spindle 1 has its bottom end supported by a bearing 5, and has its top end supported by a bearing 10. The main spindle 1 carries a turret 6 which is rigidly mounted to the half-way shaft portion of the main spindle 1. The turret 6 is configured to provide an H-form plane as shown in FIG. 4, including two pairs of arms extending outwardly. Each pair of arms carries a barrel container *7a* or *7b* which is capable of rotation between the corresponding arm pair. In the embodiment shown and currently described, the turret 6 accommodates two barrel containers such as *7a* and *7b*, but may be varied to be able to accommodate three or four barrel containers.

As the main spindle 1 is described in more detail, it includes a sleeve 9 (as shown in FIG. 5) which is rotatably mounted to the main spindle 1. The sleeve 9 has a bevel gear 11 at the bottom end thereof, and has a sprocket wheel 18 at the top end thereof. The sprocket wheel 18 has a driven connection with a driving power system including a drive motor 19, reduction gears 20, sprocket wheel 21 and chain 22. The bevel gear 11 on the sleeve 9 meshes with a bevel gear 12, 12, each of which has its own shaft 13*a*, 13*b* supported by the turret 6. Each of the shafts 13*a* and 13*b* extens outwardly through the turret 6, the exposed end of each shaft carrying a pulley 14 which is connected by means of a V-belt with a pulley 15 mounted to each of the shafts 8*a*, 8*b* supporting the corresponding respective barrel containers *7a*, *7b*. The gear ratio of the bevel gears 11 and 12, namely n12/n11, and the diameter ratio of the pulleys 14 and 15, namely n12×n15/n11×n14 as product of n15/n14 multiplied by the gear ratio 12/n11 determines the value of n/N for the barrel containers (where n and N refer to the numbers of revolutions for the barrel containers and turret, respectively).

The example shown assumes $n12/n11=\frac{1}{2}n15/n14=2$, namely $n/N=1$. In this case, each of the barrel containers completes its axial rotation after the turret has rotated through one complete revolution, with the barrel container being oriented in the same direction as it was prior to the one complete revolution of the turret.

Then, if n/N is any interger value, the barrel container is placed in the same orientation as it was before the finishing operation was started, when the turret is to be stopped at its designated position. In the example shown, the barrel container will be stopped so that its lid is positioned on the upper side. It is particularly useful in handling the mass or making its handling automatic. The value of n/N may also be changed to provide the respective numbers of revolutions and sense of the direction of rotation as appropriate, by driving both the turret's main motor 2 and the barrels' motor 19 simultaneously. It will be appreciated that the number of revolutions n must be below the value above which the contents or mass within the barrel would be forced against the barrel wall during the rotation of the barrel container. This number of revolutuions produces a resultant force of $\sqrt{1+x^2}G$ (where x is the ratio of centrifugal force and the gravity produced with $0<x\leqq 1$), from which for $\omega\geqq\sqrt{g/r}$ (where $\omega$ is the angular velocity in radians/sec., r is the radius of rotation of the mass, and g is the gravity), $n=42.2\sqrt{d}\,x^4\sqrt{1+x^2}$ (where d is the diameter of the inscribed circle across the polygonal shape of the barrel, in meters) is determined. Any number of revolutions below the above value may be used, and the barrel container may be rotated in either direction. Each barrel container 17*a*, 17*b* may contain a mass which is substantially equal to half the barrel volume, and the main spindle 1 may be rotated with the number of revolutions less than $N=42.2/\sqrt{D}$, producing a resultant force of $1G<Y\leqq\sqrt{2G}$ (where Y is the resultant force) which is given to the mass. In this way, a flow layer is formed on the mass surface, allowing the workpieces to be processed with high precision under the heavy resultant force. When the turret is rotated at a high speed with the sleeve 9 fixed non-rotationally, a centrifugal flow barrel finishing function is provided. Conversely, when the sleeve 9 is rotational while the turret is non-rotational, the barrel containers 17*a*, 17*b* alone can rotate about their respective shafts. In this case, the rotating barrel finishing function is provided. It may be appreciated from the above that the method according to the present invention provides for those different finishing functions such as the centrifugal flow barrel finishing, rotating barrel finishing under the heavy resultant force, and the usual rotating barrel finishing, which may be performed in any particular sequence. In particular, those operations which may involve those different processes can be performed in a single machine, and the steps may be implemented on any suitable programmable sequence controller or microprocessor. Thus, the operations can proceed in any particular sequence and under the various finishing conditions.

The present invention has fully been described by referring to the typical referred embodiment and the possible variations thereof. As it may be understood from the foregoing description, the method according to the present invention may be used with the conventional rotating barrel finishing machine including the turret shaft and barrel shaft arranged one perpendicular to the other, whereby an additional centrifugal force is to be produced and given to the mass within the barrel container which is rotating about its own axis. Thus, the mass can be subjected to the resultant force composed of the centrifugal force and gravity action components. In this respect, the method according to the present invention provodes the equivalent mirror or polish finishing and high-precision finishing functions of the conventional usual rotating barrel finishing method, as well as the high-efficient finishing functions. As a consequence, the time required for those finishing operations can be reduced. In the conventional rotating barrel finishing method, it is noticed that when thin plate-like workpieces are to be finished by using a fine-grain media, the water portion contained in any aqua-compound has the effect of making the media float, thereby reducing its pressure of contact against the workpieces and requiring more time to take until the finishing operation is completed. In some cases, it may be difficult to complete the finishing operation. According to the present invention, the action of the produced centrifugal force is added to the mass, cancelling that action of the water. Thus, the improved finishing efficiency can be provided.

Although the present invention has been described with reference to the several preferred embodiments thereof, it should be understood that various changes and modifications may be made without departing from the spirit and scope of the invention.

What is claimed is:

1. A method of finishing workpieces by using a turret rotatably supported by its main spindle and a plurality of polygonally-shaped barrel containers mounted on the turret and rotatably supported by their respective shafts mounted perpendicularly to the main spindle for the turret, each of the barrel containers containing workpieces to be surface-finished or otherwise processed together with an abrasive media, the workpieces and abrasive media together constituting a mass, and causing each barrel container to rotate with a number of axial revolutions n and with a number of orbital revolutions N, wherein the method comprises:

causing said each barrel containter to rotate with smaller than the numbers of axial and orbital revolutions n and N defined as follows:

$$n=42.2/\sqrt{d}\,x^4\sqrt{1+x^2}$$

where n: the number of axial revolutions per minute for said barrel container;

x: the ratio of the centrifugal force produced and gravity action, equal to $0<x\leqq 1$;

d: the diameter of the inscribed circle across the polygonal side of said barrel container; and $$N=42.2/\sqrt{D}$$

where

N: the number of revolutions per minute for said highspeed turret;

D: twice the distance, in meters, from the turret axis to barrel axis; and thereby causing a resultant force substantially equal to $1G<Y\leqq\sqrt{2}G$ where Y is defined as the resultant force to be produced, said resultant force being composed of the components of the centrifugal force and gravity action and given to the mass within said each container.

* * * * *